US005570856A

United States Patent [19]

Sharpe

[11] Patent Number: 5,570,856

[45] Date of Patent: Nov. 5, 1996

[54] DISPOSABLE SHIPPING AND DISPENSING CONTAINER

[76] Inventor: Gary L. Sharpe, 21540 Beechwood Rd., Circleville, Ohio 43113

[21] Appl. No.: 386,262

[22] Filed: Feb. 9, 1995

[51] Int. Cl.[6] ..... B65D 85/67

[52] U.S. Cl. ..... 242/588.3; 206/485

[58] Field of Search ..... 242/588.3; 206/391, 206/445, 449, 485; 220/339; 221/70, 71

[56] References Cited

U.S. PATENT DOCUMENTS

| | | | |
|---|---|---|---|
| 653,211 | 7/1900 | Calkins | 242/588.3 |
| 1,487,607 | 3/1924 | Rosen | 242/588.3 |
| 3,231,130 | 1/1966 | Foote | 221/70 |
| 3,327,846 | 6/1967 | Offray, Jr. | 242/610.6 |
| 3,698,600 | 10/1972 | Foote | 221/70 |
| 3,877,575 | 4/1975 | Cracco et al. | 206/391 |
| 3,958,768 | 5/1976 | Fairbanks | 206/391 |
| 4,576,330 | 3/1986 | Schepp | 220/339 |
| 4,696,395 | 9/1987 | Rivoli | 206/449 |
| 4,817,799 | 4/1989 | Gregerson et al. | 206/445 |
| 5,046,659 | 9/1991 | Warburton | 220/339 |
| 5,152,395 | 10/1992 | Cross | 206/485 |

FOREIGN PATENT DOCUMENTS

| | | | |
|---|---|---|---|
| 578024 | 6/1959 | Canada | 206/391 |
| 2435235 | 5/1980 | France | 206/391 |

OTHER PUBLICATIONS

Pharmex Warning Label System, Exhibit A Health Care Logistics.

*Primary Examiner*—John P. Darling
*Attorney, Agent, or Firm*—Mueller and Smith, LPA

[57] ABSTRACT

A container for shipping and dispensing a roll of coiled film stock having an associated backer configured as a generally planar member with an edged periphery. The container is formed of a housing portion which, in turn, is formed as having a bottom wall, a pair of oppositely-disposed end walls extending upwardly from the bottom wall, and a pair of oppositely-disposed side walls extending upwardly from the bottom wall between the end walls. The side and end walls of the housing define with the bottom wall a generally polygonal-shaped interior chamber configured to receive at least one roll of the coiled film stock therewithin. At least one vertical side rib is integrally formed into each of the side walls and is disposed opposite a side rib of the other side wall to form a corresponding pair of side ribs. Each of the side ribs is formed as an outwardly-extending projection defining an inner space in communication with the interior chamber and configured to receive a corresponding edge of the backer therewithin for disposing the roll within the interior chamber when the backer is received between a corresponding pair of side ribs.

20 Claims, 4 Drawing Sheets

10
28
30
38b
36
32
26
20
34
23d
23f
23c
23e
38a
23b
23a
12
16b
18b
16a
21f
21e
21d
21c
14
21b
18a
21a 10
34
36
30
28
38a
38b
22
32
12
23a
23b
23e
23f
16b
16a
23c
23d
14
26
18a
21a
21b
21c
21d
21e
21f

DISPOSABLE SHIPPING AND DISPENSING CONTAINER

BACKGROUND OF THE INVENTION

The present invention relates generally to packaging containers and more particularly to a disposable container adapted both for the shipping and dispensing of articles such as film stock rolls and the like.

Packaging containers used by industries for the distribution of goods generally have been designed as taking into account only such considerations as weight and expense. Such containers, however, heretofore have had only a relatively short usable life after the goods have been shipped. Thereafter, the goods typically are removed from their containers, and are either placed into service or are arrange for display at a point of sale. The packaging containers, accordingly, are viewed as waste which must be disposed of in an acceptable manner. Increasingly, the use of such containers having only a limited useful life has become an environmental issue as the amount of landfill space continues to decline.

In particular, there has been a disposal problem associated with the packaging of rolls of pressure sensitive adhesive labels. These rolls are formed as a coil of film stock which often is wound around a paperboard core or the like. The film stock is formed as comprising a backing strip, generally a waxed paper or the like, and a plurality of adhesive-backed labels carried on the strip. The label is removable from the film for application onto the surface of an article to be designated.

In hospital or pharmacy settings, the labels of the type herein described are used in connection with medication as warnings or to indicate dosages, routes of administration, or expiration dates. In such settings it is necessary to have a variety of different labels ready for use. Accordingly, dispensers have been designed to make multiple rolls of labels accessible to the user.

One such dispenser is described in U.S. Pat. No. 3,231,130 as comprising an open rectangular shell forming a container, and a closure having a plurality of partitions fixed therein which divide the interior of the shell into a plurality of chambers for containing the label rolls. For the dispensing of the labels, the top wall of the closure is provided with a slot adjacent an edge thereof through which the label bearing strip is threaded. A front hold-down bar is mounted on the closure and is spaced slightly from the top wall to enable the label strip to pass freely thereunder, but also to retain the strip relatively flat against the top wall. A pick-off bar, formed as a narrow, upstanding flange, is disposed across the closure above the hold-down bar to be engaged by and to support the labels as they are removed from the strip. A second hold-down bar is secured on the closure and is spaced inwardly of the rear wall thereof. The second hold-down bar functions to retain the strips in an orderly fashion, and also as a tear-off bar for the removal of excess strip material. With the dispenser loaded and closed, a user may obtain a selected label by pressing a particular strip against the top wall behind the front hold-down bar, and then sliding the strip toward the rear hold-down bar to pull the strip from the dispenser and over the edge of the slot. As the strip approaches the slot, a lip thereof is engaged to thereby hold the strip in a plane substantially perpendicular to the top wall. As the strip then passes over the edge of the slot, the label is held by the lip perpendicular to the top wall such that the inherent stiffness of the label causes the leading edge thereof to peel from the strip as it is withdrawn from the dispenser. The separated label is made to engage the pick-off bar and is held thereon to be available to the user.

Although dispensers of the type described represented an advance over the art, the construct thereof was rather involved and resulted in a container having an expense and weight precluding its use for shipping as well as dispensing label rolls. Accordingly, each roll of labels heretofore has typically been separately packaged in a blister pack arrangement wherein a transparent cavity configured to receive the roll is glued to a generally planar, paper or chip board backer. The roll and backer are inserted for use into the dispenser, the interior walls of which are configured as having inwardly-spaced slots to receive the edges of the backer. However, the separate packaging of the label rolls, and the shipping of label rolls separately from the dispenser, will be appreciated to generate an amount of packaging material waste which no longer can be considered acceptable. It is apparent, therefore, that alterative means for shipping and dispensing the rolls of adhesive labels so widely used in the medical and other fields would be well-received both by the shipping and distribution industries, and by the customers thereof. A preferred alternative would be inexpensive and light-weight, and also would be recyclable to minimize the environmental impact of its use.

BROAD STATEMENT OF THE INVENTION

Broadly, the present invention is directed to a container for shipping and dispensing a roll of coiled film stock such as a roll of adhesive labels having an associated backing. A housing is provided as having bottom, end, and side walls defining a generally polygonal-shaped interior cavity. Corresponding pairs of vertical ribs are integrally-formed into each of the side walls as outwardly-extending projections defining inner spaces in communication with the interior chamber, which spaces are configured to receive a corresponding edge of the backer of the roll for disposing the roll within the chamber. Advantageously, it has been found that the vertical ribs for receiving the backer strengthen the walls to a degree that a light-weight, recyclable polymer such as a polyvinyl chloride or the like may be used as the material of construction. Such a construction enables label rolls to be both shipped in and dispensed from a single container, thereby minimizing the waste associated therewith. Moreover, such a construction lends itself to a container system wherein a at least one divider, configured as a generally planar member having an edged periphery, is received within a corresponding pair of side ribs. Thus, the label rolls or other goods to be contained therein need not be separately packaged. This further minimizes the packaging material waste associated with the use of the container and the system of the present invention.

One aspect of the invention therefore involves a container for shipping and dispensing a roll of coiled film stock having an associated backer configured as a generally planar member with an edged periphery. The container is formed of a housing portion which, in turn, is formed as having a bottom wall, a pair of oppositely-disposed end walls extending upwardly from the bottom wall, and a pair of oppositely-disposed side walls extending upwardly from the bottom wall between the end walls. The side and end walls of the housing define with the bottom wall a generally polygonal-shaped interior chamber configured to receive at least one roll of the coiled film stock therewithin. At least one vertical side rib is integrally formed into each of the side walls and is disposed opposite a side rib of the other side wall to form a corresponding pair of side ribs. Each of the side ribs is formed as an outwardly-extending projection defining an inner space in communication with the interior chamber. The inner spaces are configured to receive a corresponding edge of the backer therewithin for disposing the roll within the interior chamber when the backer is received between a corresponding pair of side ribs.

A further aspect of the present invention involves a container system for shipping and storing goods such as label rolls, piece parts, or the like. At least one divider is provided as configured as a generally planar member having an edged periphery. For receiving the divider, a housing is formed as having a bottom wall, a pair of oppositely-disposed end walls extending upwardly from the bottom wall, and a pair of oppositely-disposed side walls extending upwardly from the bottom wall between the end walls. The side and end walls of the housing define with the bottom wall a generally polygonal-shaped interior chamber configured to receive at least one roll of the coiled film stock therewithin. At least one vertical side rib is integrally formed into each of the side walls and is disposed opposite a side rib of the other side wall to form a corresponding pair of side ribs. Each of the side ribs is formed as an outwardly-extending projection defining an inner space in communication with the interior chamber. The inner spaces are configured to receive a corresponding edge of the divider therewithin for dividing the interior chamber into at least a first and a second chamber portion.

Advantages of the present invention include the provision of a recyclable container which may be used for both the shipping and dispensing of a roll of adhesive labels or the like, thereby minimizing the waste associated therewith. The container advantageously is configured to receive the backers of the adhesive rolls, or separate dividers for use with rolls which are not separately packaged. The dividers additionally facilitate the shipping and storage of other goods such as piece parts and like sundry items. In having a design which may be inexpensively manufactured from a lightweight and thin-wall polymeric material or the like, the container of the present invention may be used for a myriad of applications simply by re-configuring the lid thereof by cutting it with a pair of scissors, or by removing a perforated portion formed thereinto. The design of the container further is amenable for disposition in any orientation to assist in the dispensing of the goods contained therein.

In short, the shipping and dispensing container and container system of the present invention provides for all of the aforementioned advantages in a relatively inexpensive and easily-fabricated design. The invention, accordingly, comprises the combination of elements and arrangement of parts which are exemplified in the following detailed description. Reference to that description and to the accompanying drawings should be had for a fuller understanding and appreciation of the nature and objects of the invention, although other objects will be obvious to those skilled in the art.

BRIEF DESCRIPTION OF THE DRAWINGS

For a fuller understanding of the nature and objects of the invention, reference should be had to the following detailed description taken in connection with the accompanying drawings wherein.

The drawings will be described further in connection with the following Detailed Description of the Invention.

DETAILED DESCRIPTION OF THE INVENTION

Figure 1:
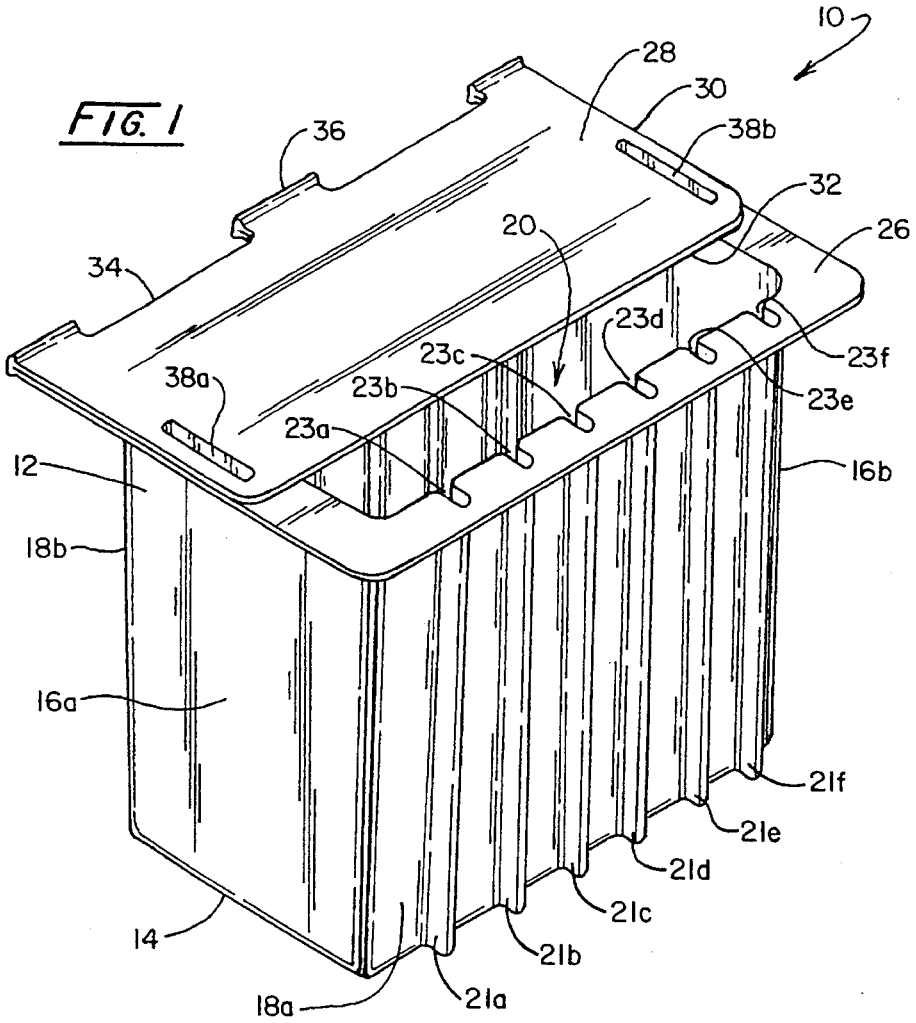
FIG. 1 is a perspective view of a container according to the present invention for shipping and dispensing a roll of coiled film stock.
Figure 2:
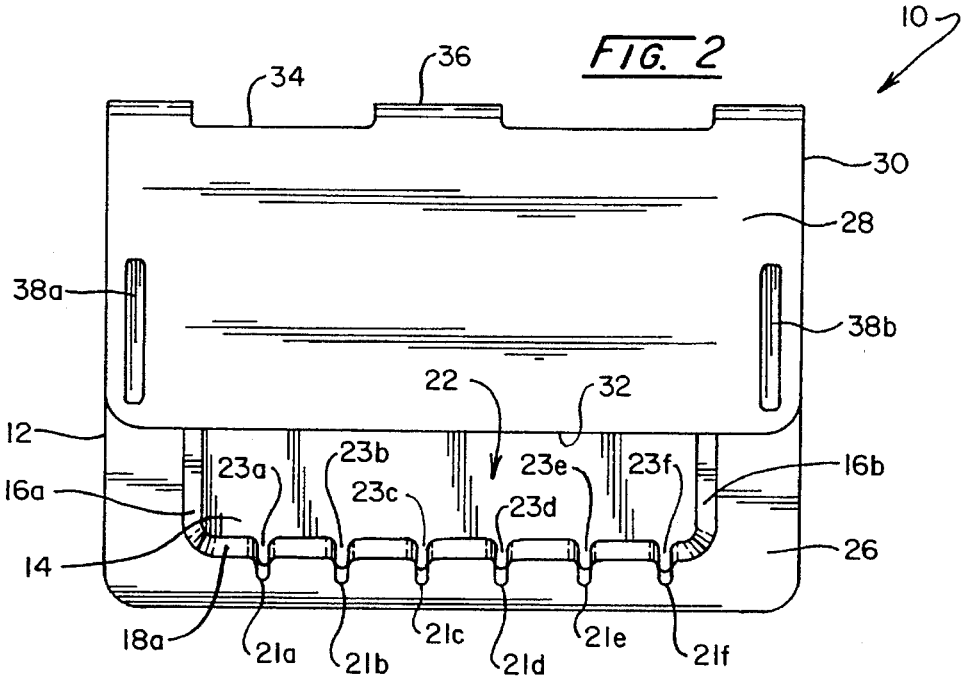
FIG. 2 is a top view of the container of FIG. 1.
Figure 3:
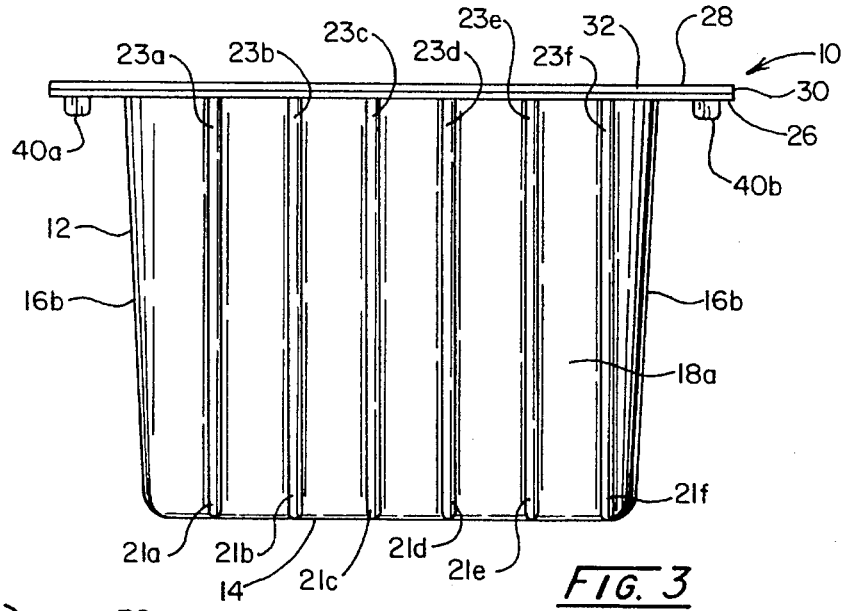
FIG. 3 is a front view of the container of FIG. 1.
Figure 4:
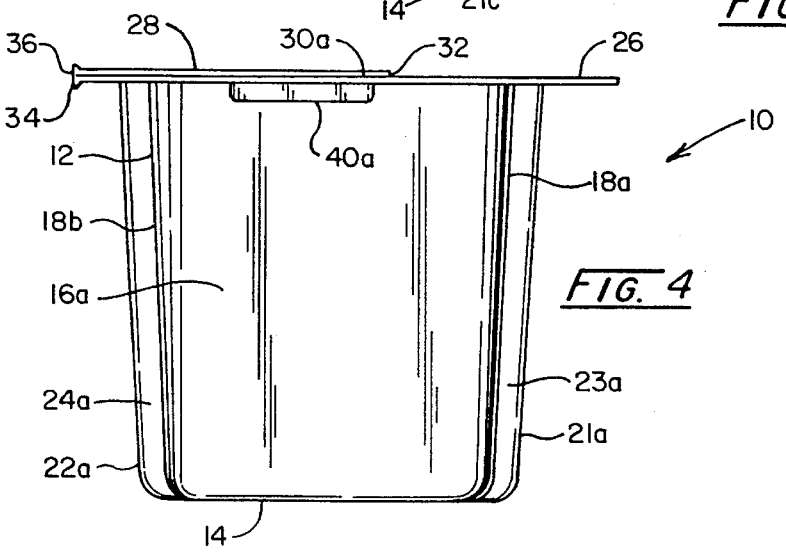
FIG. 4 is an end view of the container of FIG. 1.
Figure 5:
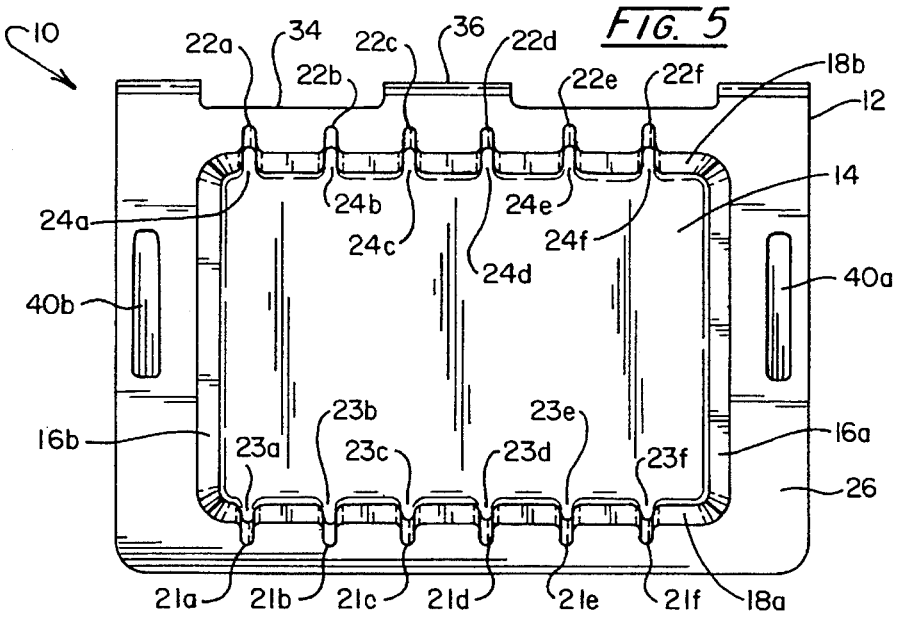
FIG. 5 is a bottom view of the container of FIG. 1.

Referring initially to FIGS. 1–5, a container in accordance with the present invention for shipping and dispensing a roll of coiled film stock or the like is shown generally at 10 to comprise a housing portion, 12. Housing portion 12 is formed as having a bottom wall, 14, a pair of oppositely-disposed end walls, 16*a* and 16*b*, extending upwardly from bottom wall 14, and a pair of oppositely-disposed side walls, 18*a* and 18*b*, extending upwardly from bottom wall 14 between end walls 16. For receiving articles therewithin, side walls 18 and end walls 16 define with bottom wall 14 a generally polygonal-shaped interior chamber, represented at 20. As is best shown in FIG. 5 at 21*a* and 22*a*, at least one vertical side rib is formed into each of side walls 18 as an outwardly-extending projection defining an inner space, 23*a* and 24*a*, in communication with interior chamber 20. Side ribs 21*a* and 22*a* are opposingly disposed in side walls 18 to form a pair of corresponding side ribs. Additional corresponding side rib pairs are shown in FIG. 5 at 21*b* and 22*b*, 21*c* and 22*c*, 21*d* and 22*d*, 21*e* and 22*e*, and 21*f* and 22*f*, as having, respectively, associated inner spaces 23*b*, 24*b*, 23*c*, 24*c*, 23*d*, 24*d*, 23*e*, 24*e*, 23*f*, and 24*f*.

Housing portion 12 additionally may be provided with an outwardly-projecting flanged portion, 26, integrally formed from end walls 16 and side walls 18 to extend about the periphery of interior chamber 20 opposite bottom wall 14. In this regard, flanged portion 26 may be seen as being configured to receive a top wall or lid, 28, integrally formed into housing portion 12 opposite bottom wall 14. Top wall 28 is formed as having a generally polygonal-shaped periphery, 30, defined by a forward and a rearward edge, 32 and 34, respectively, rearward edge 34 forming an integral or "living" hinge, 36, with flanged portion 26. As is shown in FIGS. 1–5, top wall 28 is pivotal about hinge 36 for disposition in a closed orientation covering a portion of interior chamber 20. For its releasable locking in such closed orientation, top wall 28 is formed as having at least one protrusion, 38*a* and 38*b*, extending therefrom, which protrusion is received in an interlocking relationship in a corresponding cavity, 40*a* and 40*b*, formed into flanged portion 26.

Figure 6:
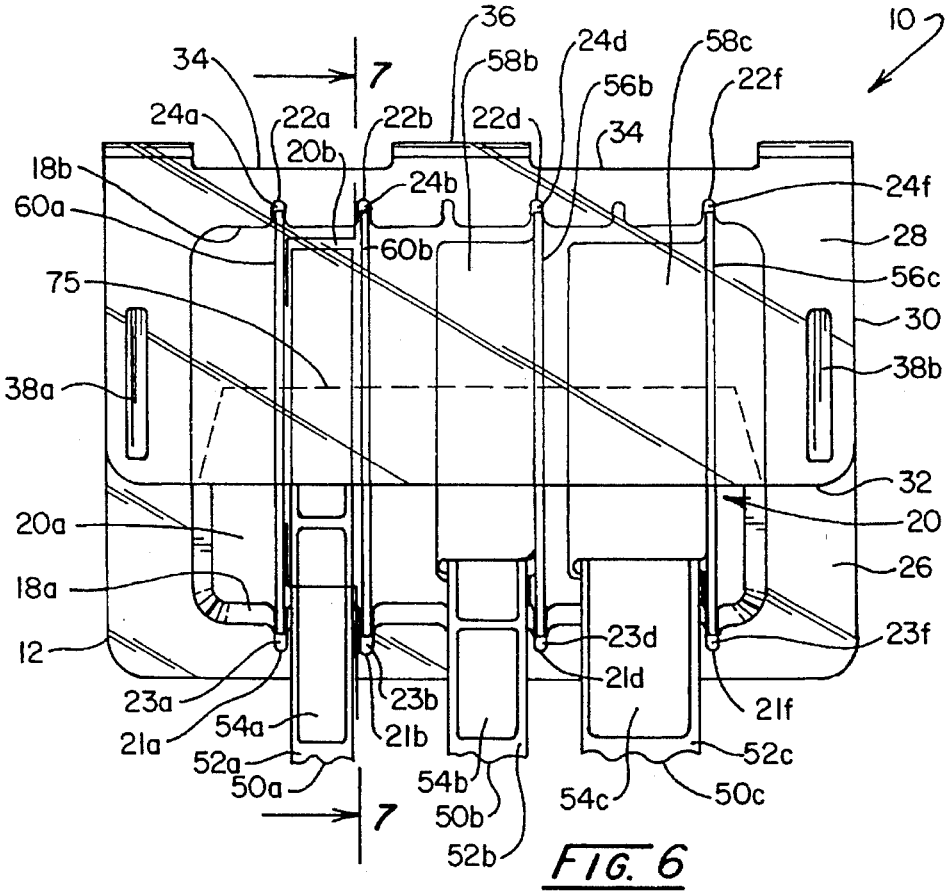
FIG. 6 is a top view of a container and container system according to the present invention shown as receiving a number of rolls of coiled film stock.
Figure 7:
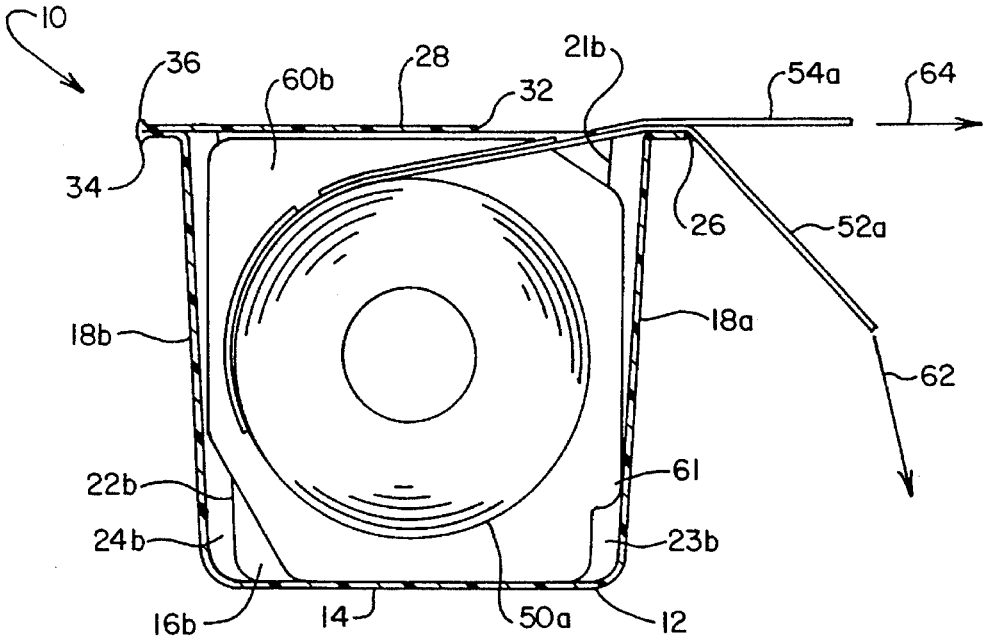
FIG. 7 is a cross-sectional view of the container of FIG. 6 taken through line 7—7 of FIG. 6.

Referring next to FIGS. 6 and 7, wherein like reference numerals are used to designate like parts, container 10 is shown as having a transparent housing 12 receiving within interior chamber 20 a number of rolls of coiled film stock or the like, 50*a*, 50*b*, and 50*c*, of varying widths. For purposes of illustration, the film stock of rolls 50 is shown to comprise a backing strip or release sheet, 52*a*, 52*b*, and 52*c*, which typically is provided as a waxed or siliconed paper selected as having a low surface energy, and a plurality of pressure sensitive adhesive-backed labels, one of which is shown at 54*a*, 54*b*, and 54*c*. Rolls 50*b* and 50*c* additionally comprise an associated backer, 56*b* and 56*c*, configured as a generally planar member having an edged periphery, which member may be formed from a paper or chip board or the like. A blister-type cover, 58*b* and 58*c*, formed of a transparent plastic material such as a cellophane or a polyethylene, is glued or otherwise attached to backers 56*b* and 56*c* to retain rolls 50*b* and 50*c* therewithin. Roll 50*a* is provided has having a pair of associated dividers, 60*a* and 60*b*, each configured as a generally planar member having an edged periphery and preferably formed of a paper or chip board material or the like. Each of dividers 60 functions to segregate interior chamber 60 into at least a first and a second chamber portion, as is shown at 20*a* and 20*b* for divider 60*a*.

In accordance with the precepts of the present invention, each of dividers 60 and backers 56 are received between a corresponding side rib pair 21 and 22. Particularly, dividers 60*a* and 60*b* are shown being received, respectively, between side rib pairs 21*a* and 22*a*, and 21*b* and 22*b*, with backer 56*b* shown being received between side rib pair 21*d* and 22*d*, and backer 56*c* shown being received between side rib pair 21*f* and 22*f*. It will be appreciated that each of inner spaces 23 and 24 in communication with interior chamber 20 are configured to receive a corresponding edge of a divider 60 or a backer 56. In this regard, each of ribs 21 and 22 functions synergistically both to strengthen and stiffen side walls 18 and to receive a backer 56 or a divider 60. As is shown in FIG. 7, side walls 18 preferably are provided to sloped generally inwardly to bottom wall 14. Such sloping, as is shown at 61, effects a mechanical retaining or capturing of backers 56 or dividers 60 which may be configured as having peripheries with generally parallel edges.

As aforementioned, top wall or lid 28 is provided to cover only a portion of interior cavity 20 when disposed in a closed orientation. Advantageously, the leaders of rolls 50 are receivable through the uncovered portion of interior chamber 20 to be dispensable over flanged portion 26. In this way, rolls 50 are retained in container 10 and yet are dispensable therethrough. As is illustrated in FIG. 7, labels 54 may be separated from backing strip 52 via the application of a generally downward force, represented at 62, to strip 52*a*, for example, while label 54*a* carried thereon is supported on flange portion 26. The stiffness of the label 54 will be appreciated to result in its separation from strip 52 along the tangent, represented at 64, extending therebetween.

Although container 10 has been illustrated in FIGS. 6 and 7 as receiving film stock rolls 50, it will be appreciated that the provision of dividers 60 within interior chamber 20 makes container 10 amenable as a system for receiving and dispensing various articles such as plastic bags, medication or specimen cups, medication droppers or spray bottles, and other sundry items. In this regard, dividers 60 apportion interior chamber 20 into a number of interior compartments for segregating the articles contained therewithin. Looking momentarily to FIG. 9, housing 12 is shown as provided with at least one vertical end rib, one of which is shown at 70, integrally formed into each of end walls 16 as an outwardly-extending projection defining an inner space, represented at 72, configured to receive a corresponding edge of a backer 56 or, as is shown 74, a divider 60. As were side ribs 21 and 22, each of end ribs 70 are disposed opposite a corresponding end rib in the other end wall 16 to form a corresponding end rib pair for receiving a backer or divider therebetween. In this way, a roll 50 of film stock may be disposed within interior chamber 20 across the lengthwise extent of housing portion 12 between end walls 16 thereof, or, alternatively, interior chamber 20 may be divided into lengthwise compartments which may be further subdivided by additional dividers received between side rib pairs 21 and 22. Returning to FIG. 6, it may be seen that top wall 28 may be provided as having a perforated portion, represented by the dashed line shown at 75, which is removable therefrom to enlarge the uncovered portion of interior chamber 20 and thereby facilitate the dispensing of the sundry items out of container 10.

Figure 9:
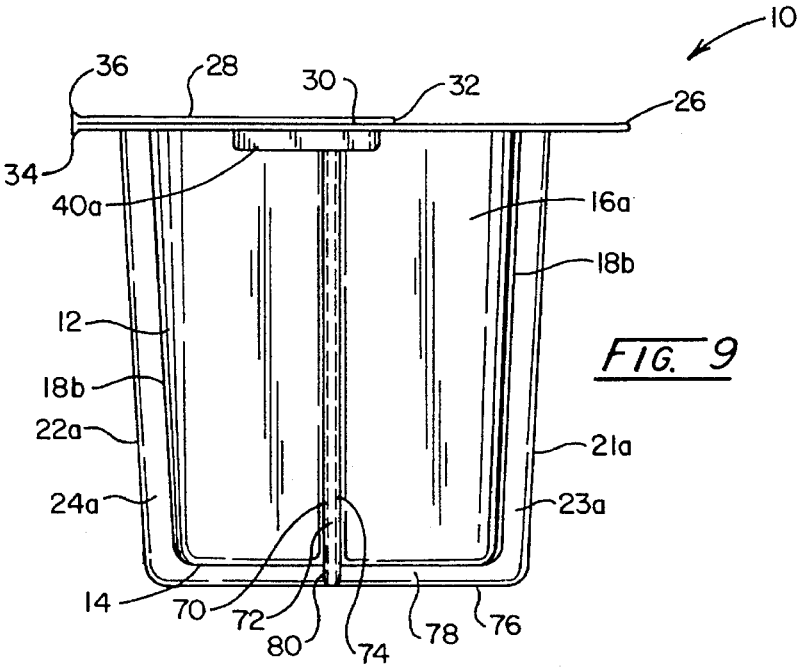
FIG. 9 is an end view of another embodiment of a container according to the present invention configured as having bottom and end ribs and shown as receiving a divider within the end ribs.

Continuing with FIG. 9, bottom wall 14 may be provided as having at least one horizontal bottom rib, one of which is shown at 76. Each bottom rib 76 is integrally-formed into bottom wall 14 to extend between a corresponding pair of side ribs 21 and 22. As were side ribs 21–22 and end ribs 70, each bottom rib 76 is configured as an outwardly-extending projection defining an inner space, represented at 78, configured to receive a corresponding edge of a backer 56 or a divider 60. As is shown at 80, each of end ribs 70 may be extended to interconnect with bottom ribs 76.

Figure 8:
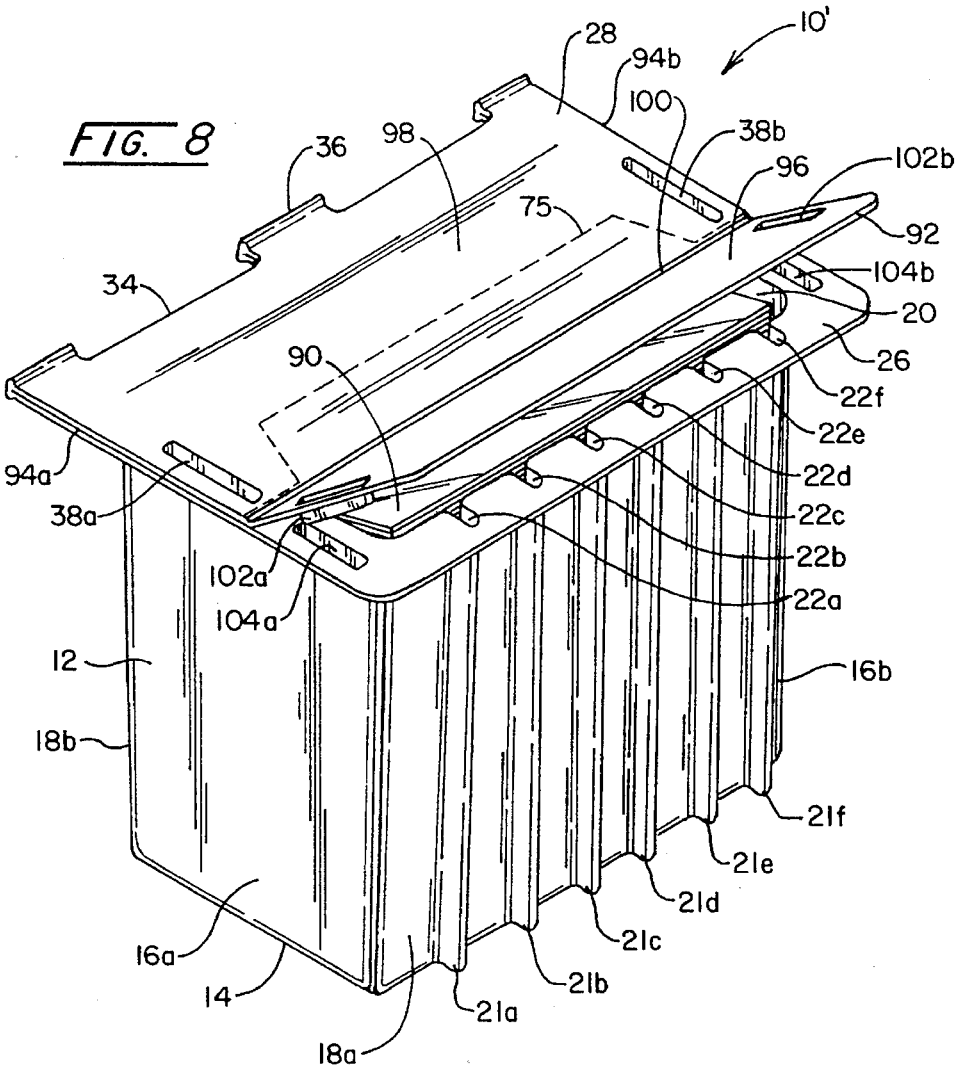
FIG. 8 is a perspective view of another embodiment of a container according to the present invention configured as having a bi-fold top wall or lid and shown as receiving an arrangement of plastic bags.

Looking next to FIG. 8, an alternative embodiment of container 10 is shown at 10' as receiving a Z-folded stack of plastic bags or the like, 90. In this embodiment, top wall 28 is formed as extending between rearward edge 34 and a forward edge, 92, and pair of oppositely-disposed side edges, 94*a* and 94*b*, to define a generally polygonal-shaped periphery. Again, rearward edge 34 forms an integral hinge 36 with flanged portion 26 about which top wall is pivotal for disposition in a closed orientation covering interior chamber 20. However, to divide top wall 28 into a forward top wall portion, 96, and a rearward top wall portion, 98, a second integral or "living" hinge, 100, is provided to extend between side edges 94 intermediate first hinge 36 and forward edge 92. As is shown, with rearward top wall portion 98 disposed in a closed orientation, forward top wall portion 96 is pivotal about second hinge 100 to be disposable in an opened orientation uncovering a portion of interior chamber 20 through which bags 90 or, alternatively, film stock rolls 50 (FIG. 6) may be dispensed. In this way, a bi-fold lid is provided to further broaden the shipping and dispensing applications to which container 10 is suited. For its releasable locking in a closed orientation, forward wall portion 96 may be formed as having at least one protrusion, 102*a* and 102*b*, extending therefrom, which protrusion is received in an interlocking relationship in a corresponding cavity, 104*a* and 104*b*, formed into flanged portion 26. To provide better access to the bags 90 or other sundry items received in interior chamber 20, forward wall portion 96 is made to be detachable form the remainder of top wall portion 28 along perforation line 75.

As to the materials of construction for forming the container and system of the present invention, a transparent thermoplastic material such as a polyvinyl chloride (PVC) or the like is preferred. Transparency is desired as allowing the contents of the container to be viewed from any angle, while thermoplasticity is desired to facilitate the manufacturing of the container through thermoforming or other melt-based processing methods, such as injection or blow molding, to achieve a light-weight and recyclable product. However, any recyclable material, such as a paper or chip board or the like, having the necessary strength and rigidity for the particular application envisioned is suitable. As to the wall thickness of the selected materials of construction, for thermoplastic materials, a thickness of about 0.024 gauge is preferred. For paper or chip board materials, it will be appreciated that the wall construction thereof, i.e., single-ply, double-ply, or higher, may be varied depending upon the application.

It is anticipated that certain changes may be made in the present invention without departing from the precepts herein involved. For example, although the container of the present invention is illustrated has having a continuous bottom wall, it will be appreciated that a partial bottom wall having an opening therethrough to form a flanged inner periphery may be substituted. Additionally, the integral rear hinge between the top wall and a side wall may be reconfigured as a side hinge interposed between the top wall and an end wall. Accordingly, it is intended that all matter contained in the foregoing description shall be interpreted as illustrative mid not in a limiting sense.

What is claimed:

1. A container for shipping and dispensing a roll of coiled film stock, said roll being rotatable about an axis thereof for uncoiling said film stock and having an associated backer configured as a generally planar member with an edged periphery, said container comprising:

a housing portion formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber configured to receive at least one said roll of coiled film stock therewithin;

at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said backer therewithin for disposing said roll within said interior chamber when said backer is received between a said corresponding pair of side ribs; and at least one horizontal bottom rib integrally formed into said bottom wall to extend between a corresponding said pair of side ribs, each said bottom rib being formed as an outwardly-extending projection defining an inner space in communication with said interior chamber and configured to receive a corresponding edge of said backer therewithin for disposing said roll within said interior chamber when said backer is received between a said corresponding pair of end ribs.

2. The container of claim 1 wherein said housing portion is formed from a transparent thermoplastic material.

3. The container of claim 2 wherein said transparent thermoplastic material is a polyvinyl chloride.

4. The container of claim 1 further comprising at least one vertical end rib integrally formed into each of said end walls and disposed opposite a said end rib of the other said end wall to form a corresponding pair of end ribs, each said end rib being formed as an outwardly-extending projection defining an inner space in communication with said interior chamber and configured to receive a corresponding edge of said backer therewithin for disposing said roll within said interior chamber when said backer is received between a said corresponding pair of end ribs.

5. A container for shipping and dispensing a roll of coiled film stock, said roll being rotatable about an axis thereof for uncoiling said film stock and having an associated backer configured as a generally planar member with an edged periphery, said container comprising:

a housing portion formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber configured to receive at least one said roll of coiled film stock therewithin;

at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said backer therewithin for disposing said roll within said interior chamber when said backer is received between a said corresponding pair of side ribs;

an outwardly-projecting flanged portion integrally formed from said end and side walls to extend about the periphery of said interior chamber opposite said bottom wall; and a top wall integrally formed into said housing portion opposite said bottom wall as having a generally polygonal-shaped periphery defined by a forward and a rearward edge and a pair of oppositely-disposed side edges extending between said forward and said rearward edge, said rearward edge wall forming a hinge with said flanged portion about which said top wall is pivotal for disposition in a closed orientation covering a portion of said interior chamber, the uncoiled film stock from said roll being receivable through the uncovered portion of said interior chamber being dispensable over said flanged portion through the uncovered portion of said interior chamber.

6. The container of claim 5 wherein said top wall is formed as having at least one protrusion extending therefrom, and wherein said flanged portion is formed has having at least one cavity formed thereinto configured to receive a corresponding said protrusion in an interlocking engagement, each said protrusion being received in each corresponding said cavity when said top wall is disposed in said closed orientation.

7. The container of claim 5 wherein said top wall is formed as having a perforated portion removable therefrom to enlarge the uncovered portion of said interior chamber when said top wall is disposed in said closed orientation.

8. A container for shipping and dispensing a roll of coiled film stock, said roll being rotatable about an axis thereof for uncoiling said film stock and having an associated backer configured as a generally planar member with an edged periphery, said container comprising:

a housing portion formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber configured to receive at least one said roll of coiled film stock therewithin;

at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said backer therewithin for disposing said roll within said interior chamber when said backer is received between a said corresponding pair of side ribs;

an outwardly-projecting flanged portion integrally formed from said end and side walls to extend about the periphery of said interior chamber opposite said bottom wall; and a top wall integrally formed into said housing portion opposite said bottom wall as having a generally polygonal-shaped periphery defined by a forward and a rearward edge and a pair of oppositely-disposed side edges extending between said forward and said rearward edge, said rearward edge wall forming a first hinge with said flanged portion about which said top wall is pivotal for disposition in a closed orientation coveting said interior chamber, and said top wall being formed as having a second hinge extending between said side edges intermediate said first hinge and said forward edge to divide said top wall into a forward and a rearward top wall portion, said forward top wall portion being pivotal about said second hinge to uncover a portion of said interior chamber for dispensing the uncoiled film stock from said roll over said flanged portion.

9. The container of claim 8 wherein said top wall is formed as having at least one protrusion extending therefrom, and wherein said flanged portion is formed has having at least one cavity formed thereinto configured to receive a corresponding said protrusion in an interlocking engagement, each said protrusion being received in each corresponding said cavity when said top wall is disposed in said closed orientation.

10. The container of claim 8 wherein said top wall is formed as having a perforated portion disposed intermediate said forward and said rearward top wall portion, said forward top wall portion being removable from said top wall along said perforated portion.

11. A container system comprising:

at least one divider configured as a generally planar member having an edged periphery;

a housing formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber, at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said divider therewithin for dividing said interior chamber into at least a first and a second chamber portion; and at least one horizontal bottom rib integrally formed into said bottom wall to extend between a corresponding said pair of side ribs, each said bottom rib being formed as an outwardly-extending projection defining an inner space in communication with said interior chamber and configured to receive a corresponding edge of said divider therewithin when said divider is received between a said corresponding pair of end ribs.

12. The container system of claim 11 wherein said housing is formed from a transparent thermoplastic material.

13. The container system of claim 12 wherein said transparent thermoplastic material is a polyvinyl chloride.

14. The container system of claim 11 further comprising at least one vertical end rib integrally formed into each of said end walls and disposed opposite a said end rib of the other said end wall to form a corresponding pair of end ribs, each said end rib being formed as an outwardly-extending projection defining an inner space in communication with said interior chamber and configured to receive a corresponding edge of a said divider therewithin for further dividing said interior chamber into interior chamber portions.

15. A container system comprising:

at least one divider configured as a generally planar member having an edged periphery;

a housing formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber;

at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said divider therewithin for dividing said interior chamber into at least a first and a second chamber portion;

an outwardly-projecting flanged portion integrally formed from said end and side walls to extend about the periphery of said interior chamber opposite said bottom wall; and a top wall integrally formed into said housing opposite said bottom wall as having a generally polygonal-shaped periphery defined by a forward and a rearward edge and a pair of oppositely-disposed side edges extending between said forward and said rearward edge, said rearward edge wall forming a hinge with said flanged portion about which said top wall is pivotal for disposition in a closed orientation covering a portion of said interior chamber, the uncoiled film stock from said roll being receivable through the uncovered portion of said interior chamber being dispensable over said flanged portion through the uncovered portion of said interior chamber.

16. The container system of claim 15 wherein said top wall is formed as having at least one protrusion extending therefrom, and wherein said flanged portion is formed has having at least one cavity formed thereinto configured to receive a corresponding said protrusion in an interlocking engagement, each said protrusion being received in each corresponding said cavity when said top wall is disposed in said closed orientation.

17. The container system of claim 15 wherein said top wall is formed as having a perforated portion removable therefrom to enlarge the uncovered portion of said interior chamber when said top wall is disposed in said closed orientation.

18. A container system comprising:

at least one divider configured as a generally planar member having an edged periphery;

a housing formed as having a bottom wall, a pair of oppositely-disposed end walls extending upwardly from said bottom wall, and a pair of oppositely-disposed side walls extending upwardly from said bottom wall between said end walls, said side and end walls defining with said bottom wall a generally polygonal-shaped interior chamber;

at least one vertical side rib integrally formed into each of said side walls and disposed opposite a said side rib of the other said side wall to form a corresponding pair of side ribs, each said side rib formed as an outwardly-extending projection defining an inner space in communication with said interior chamber and configured to receive a corresponding edge of said divider therewithin for dividing said interior chamber into at least a first and a second chamber portion;

an outwardly-projecting flanged portion integrally formed from said end and side walls to extend about the periphery of said interior chamber opposite said bottom wall; and a top wall integrally formed into said housing opposite said bottom wall as having a generally polygonal-shaped periphery defined by a forward and a rearward edge and a pair of oppositely-disposed side edges extending between said forward and said rearward edge, said rearward edge wall forming a first hinge with said flanged portion about which said top wall is pivotal for disposition in a closed orientation covering said interior chamber, and said top wall being formed as having a second hinge extending between said side edges intermediate said first hinge and said forward edge to divide said top wall into a forward and a rearward top wall portion, said forward top wall portion being pivotal about said second hinge to uncover a portion of said interior chamber for dispensing the uncoiled film stock from said roll over said flanged portion.

19. The container system of claim 18 wherein said top wall is formed as having at least one protrusion extending therefrom, and wherein said flanged portion is formed has having at least one cavity formed thereinto configured to receive a corresponding said protrusion in an interlocking engagement, each said protrusion being received in each corresponding said cavity when said top wall is disposed in said closed orientation.

20. The container of claim 18 wherein said top wall is formed as having a perforated portion disposed intermediate said forward and said rearward top wall portion, said forward top wall portion being removable from said top wall along said perforated portion.

* * * * *